US006333144B1

(12) United States Patent
Nomura et al.

(10) Patent No.: US 6,333,144 B1
(45) Date of Patent: Dec. 25, 2001

(54) DEVELOPING PROCESSING METHOD AND APPARATUS

(75) Inventors: Hideaki Nomura; Kazuo Sanada, both of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/473,125

(22) Filed: Dec. 28, 1999

(30) Foreign Application Priority Data

Dec. 28, 1998 (JP) ..... 10-373556

(51) Int. Cl.[7] ..... G03D 13/04; G03C 5/00

(52) U.S. Cl. ..... 430/413; 430/434; 430/499; 430/963; 396/636

(58) Field of Search ..... 430/311, 413, 430/434, 499, 963; 347/108; 396/636

(56) References Cited

U.S. PATENT DOCUMENTS

| | | | |
|---|---|---|---|
| 5,355,190 | 10/1994 | Rosenburgh et al. | 354/324 |
| 5,389,994 | 2/1995 | Rosenburgh et al. | 354/324 |
| 5,736,305 | 4/1998 | Nomura | 430/403 |
| 5,890,028 | 3/1999 | Nomura et al. | 396/571 |
| 6,207,360 * | 3/2001 | Ishikawa et al. | 430/434 |

FOREIGN PATENT DOCUMENTS

| | | | |
|---|---|---|---|
| 2-46453 | 2/1990 | (JP) | G03D/3/00 |

* cited by examiner

*Primary Examiner*—Shean C. Wu

(57) ABSTRACT

In a developing processing method and apparatus in which developing processing is carried out in such a manner that a processing solution is jetted from jetting holes to an emulsion surface of a photosensitive material, a hole diameter of the jetting holes is set to be 0.5 mm to 0.9 mm. In this case, clogging of the jetting holes does not easily occur and the processing solution can be jetted from the jetting holes stably for a long period of time. Accordingly, non-uniform processing is rarely caused. Intervals between the jetting holes in the transverse direction of the photosensitive material are each in a range of 3.0 mm to 4.5 mm. The jetting holes are disposed in such a manner that jetting holes of adjacent three rows in a direction in which the photosensitive material is conveyed are located at different positions to form a staggered arrangement, and the three rows of jetting holes are formed repeatedly. By substantially shortening the intervals between the jetting holes in the transverse direction of the photosensitive material, non-uniform processing does not occur even in a photosensitive material having a large transverse direction, and a desired photographic property can be obtained.

18 Claims, 4 Drawing Sheets

DEVELOPING PROCESSING METHOD AND APPARATUS

BACKGROUND OF THE INVENTION

1. Field of the Invention

The present invention relates to a developing processing apparatus in which a silver halide color photographic photosensitive material (hereinafter referred to as a photosensitive material) is subjected to developing processing, and a developing processing method in which the developing processing apparatus can be applied.

2. Description of the Related Art

As an example of a developing processing apparatus, there has been proposed a system in which a photosensitive material is subjected to developing processing in such a manner that a processing solution is jetted from jetting holes of a blowoff chamber, which blowoff chamber is disposed on a conveying path of the photosensitive material, toward an emulsion surface of the photosensitive material, and a processing solution in a processing tank is agitated (see Japanese Patent Application Laid-Open (JP-A) No. 2-46,453).

The above-mentioned developing processing apparatus and a developing processing method using the same cause no problem in developing processing for a small-size photosensitive material for photography and the like. However, when a photosensitive material having a large transverse dimension is used, non-uniform processing is caused and a desired photographic property is not obtained.

It is considered that the above-described problem arises from an arrangement pattern of jetting holes and a hole diameter of the jetting holes. In order to prevent clogging of the jetting holes, which causes non-uniform processing, it is preferable that the hole diameter of the jetting holes be made larger. However, the capacity of conventional pumps is small, and therefore, flow velocity of jet flow decreases and a desired photographic property cannot be obtained. Further, as long as the number of jetting holes is reduced, the flow velocity of jet flow can be increased even in conventional pumps, but in this case, non-uniform processing is caused.

However, in conventional developing processing apparatuses and developing processing methods using the same, the arrangement pattern of jetting holes and the hole diameter of the jetting holes are not set due to viewpoints like the above. Further, in the conventional cases, no solutions based on an examination of other causes of non-uniform processing has been found.

SUMMARY OF THE INVENTION

In view of the above-mentioned circumstances, an object of the present invention is to provide a developing processing method and apparatus in which a necessary jet flow can be realized even in conventional pumps and a desired photographic property can be obtained without causing non-uniform processing arising from clogging.

A first aspect of the present invention is a developing processing apparatus equipped with a blowoff chamber having jetting holes from which a processing solution is jetted toward an emulsion surface of a photosensitive material, wherein the jetting holes are formed in such a manner that a hole diameter thereof is in a range of 0.5 mm to 0.9 mm and intervals thereof in a transverse direction of the photosensitive material are each in a range of 3.0 mm to 4.5 mm, and the jetting holes are arranged in a staggered manner in a direction in which the photosensitive material is conveyed; and a number of the jetting holes is set in accordance with capacity of a pump for sending the processing solution to the blowoff chamber so that flow velocity of the processing solution jetted from the jetting holes becomes a value in a range of 680 to 1,200 mm/sec.

The apparatus of the first aspect is a photosensitive material processing apparatus provided to process a photosensitive material and having a processing tank in which a processing solution is filled, and the photosensitive material processing apparatus comprises a blowoff chamber having a jetting holes, the jetting holes being formed in such a manner that a hole diameter thereof is in a range of 0.5 mm to 0.9 mm and intervals thereof in a transverse direction of the photosensitive material are each in a range of 3.0 mm to 4.5 mm, and the jetting holes are arranged in a staggered manner in a direction in which the photosensitive material is conveyed, and a number of the jetting holes is set so that flow velocity of the processing solution jetted from the jetting holes becomes a value in a range of 680 to 1,200 mm/sec.

According to the first aspect of the present invention, developing processing is carried out in such a manner that the processing solution is jetted from the jetting holes of the blowoff chamber to the emulsion surface of the photosensitive material.

Further, the hole diameter of the jetting holes is in the range of 0.5 mm to 0.9 mm. In this case, clogging of the jetting holes does not easily occur and the processing solution can be jetted from the jetting holes stably for a long period of time, and therefore, non-uniform processing is rarely caused.

The jetting holes are arranged in rows and in a staggered manner. The intervals of adjacent jetting holes in the transverse direction of the photosensitive material are each in the range of 3. 0 mm to 4. 5 mm. If the jetting holes are arranged to form a two-row zigzag pattern repeatedly, intervals of the jetting holes are each substantially in the range of 1.5 mm to 2.25 mm when the jetting holes are viewed from the direction in which the photosensitive material is conveyed. Further, if the jetting holes are arranged to form a three-row zigzag pattern repeatedly, intervals of the jetting holes are each substantially in the range of 1.0 mm to 1.5 mm when the jetting holes are viewed from the direction in which the photosensitive material is conveyed.

By substantially shortening the intervals of the jetting holes in the transverse direction of the photosensitive material as described above, non-uniform processing does not occur even with photosensitive materials having a large transverse dimension and desired photographic properties can be obtained. Examples of the photosensitive materials having a large transverse dimension include photographic printing papers of sixmo-size (203 mm×254 mm) or quarto-size (254 mm×305 mm).

The developing processing method and apparatus according to the present invention can be applied most suitably to a color paper developing processing method and apparatus in which photosensitive materials of various sizes can be processed, for example, from E size (82.5 mm×117 mm) or L size (89 mm×127 mm), having a small transverse dimension, to the above-described photosensitive materials having a large transverse dimension.

Further, the number of jetting holes is set in accordance with the capacity of the pump for sending the processing solution to the blowoff chamber so that the flow velocity of the processing solution jetted from the jetting holes is set to be in the range of 680 to 1,200 mm/sec. As a result, even when conventional pumps are used, the jet flow velocity can be increased, and therefore, ability to agitate the processing solution can be maintained.

A second aspect of the present invention is structured in such a manner that, in the above-mentioned first aspect, the photosensitive material is nipped and conveyed by rollers disposed at upstream and downstream sides of the blowoff chamber in the direction in which the photosensitive material is conveyed such that an interval between the jetting holes and the emulsion surface of the photosensitive material is in a range of 2.0 mm to 20.0 mm.

Due to the above-mentioned structure, non-uniform processing of the photosensitive material does not occur in a region of the photosensitive material directly facing the jetting holes and in the peripheries thereof.

A third aspect of the present invention is structured in such a manner that, in the above-described first aspect, the number of jetting holes is set in accordance with a capacity of a pump for sending the processing solution to the blowoff chamber such that the flow velocity of the processing solution jetted from the jetting holes is in the range of 700 to 1,000 mm/sec. and the hole diameter of the jetting holes is in the range of 0.5 mm to 0.8 mm.

A fourth aspect of the present invention is structured in such a manner that, in the above-described first aspect, the photosensitive material is nipped and conveyed by rollers disposed at upstream and downstream sides of the blowoff chamber such that the interval between the jetting holes and the emulsion surface of the photosensitive material is more preferably in the range of 5.0 mm to 10.0 mm.

A fifth aspect of the present invention is structured in such a manner that, in the above-described first aspect, the jetting holes are disposed in plural rows, and adjacent three rows of the jetting holes are located at different position from each other to form the staggered arrangement, and the three rows of holes are formed repeatedly on a jetting panel.

A sixth aspect of the present invention is a developing processing method in which a processing solution is jetted toward an emulsion surface of a photosensitive material by a blowoff chamber having jetting holes formed therein, wherein the jetting holes are formed in such a manner that a hole diameter thereof is in a range of 0.5 mm to 0.9 mm and intervals thereof in a transverse direction of the photosensitive material are each in a range of 3.0 mm to 4.5 mm, and the jetting holes are arranged in a staggered manner in a direction in which the photosensitive material is conveyed; and flow velocity of the processing solution jetted from the jetting holes becomes a value in a range of 680 to 1,200 mm/sec by setting a number of the jetting holes in accordance with capacity of a pump for sending the processing solution to the blowoff chamber.

The method of the sixth aspect is a photosensitive material processing method in which a processing solution is jetted toward an emulsion surface of a photosensitive material by a blowoff chamber having jetting holes formed therein, which jetting holes are formed in such a manner that a hole diameter of the jetting holes is in a range of 0.5 mm to 0.9 mm and intervals thereof in a transverse direction of the photosensitive material are each in a range of 3.0 mm to 4.5 mm, and the jetting holes are arranged in a staggered manner in a direction in which the photosensitive material is conveyed, the method comprising the step of jetting a processing solution so that flow velocity of the processing solution jetted from the jetting holes becomes a value in a range of 680 to 1,200 mm/sec.

Seventh to tenth aspects of the present invention are, in the above-described sixth aspect, similar to the second to fifth aspects of the present invention, respectively.

DESCRIPTION OF THE PREFERRED EMBODIMENTS

Figure 1:
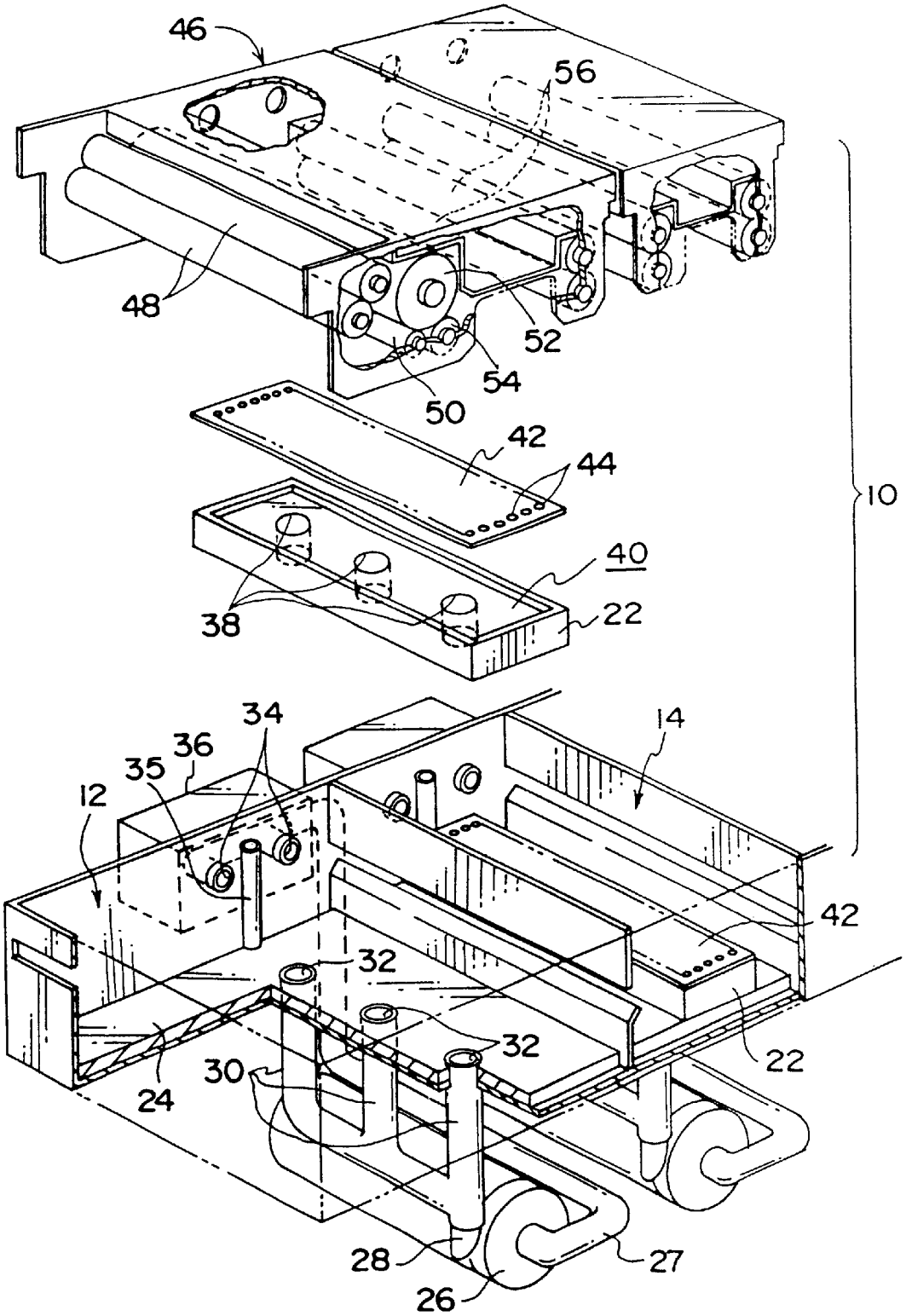
FIG. 1 is an exploded perspective view of a developing processing apparatus according to an embodiment of the present invention.
Figure 2:
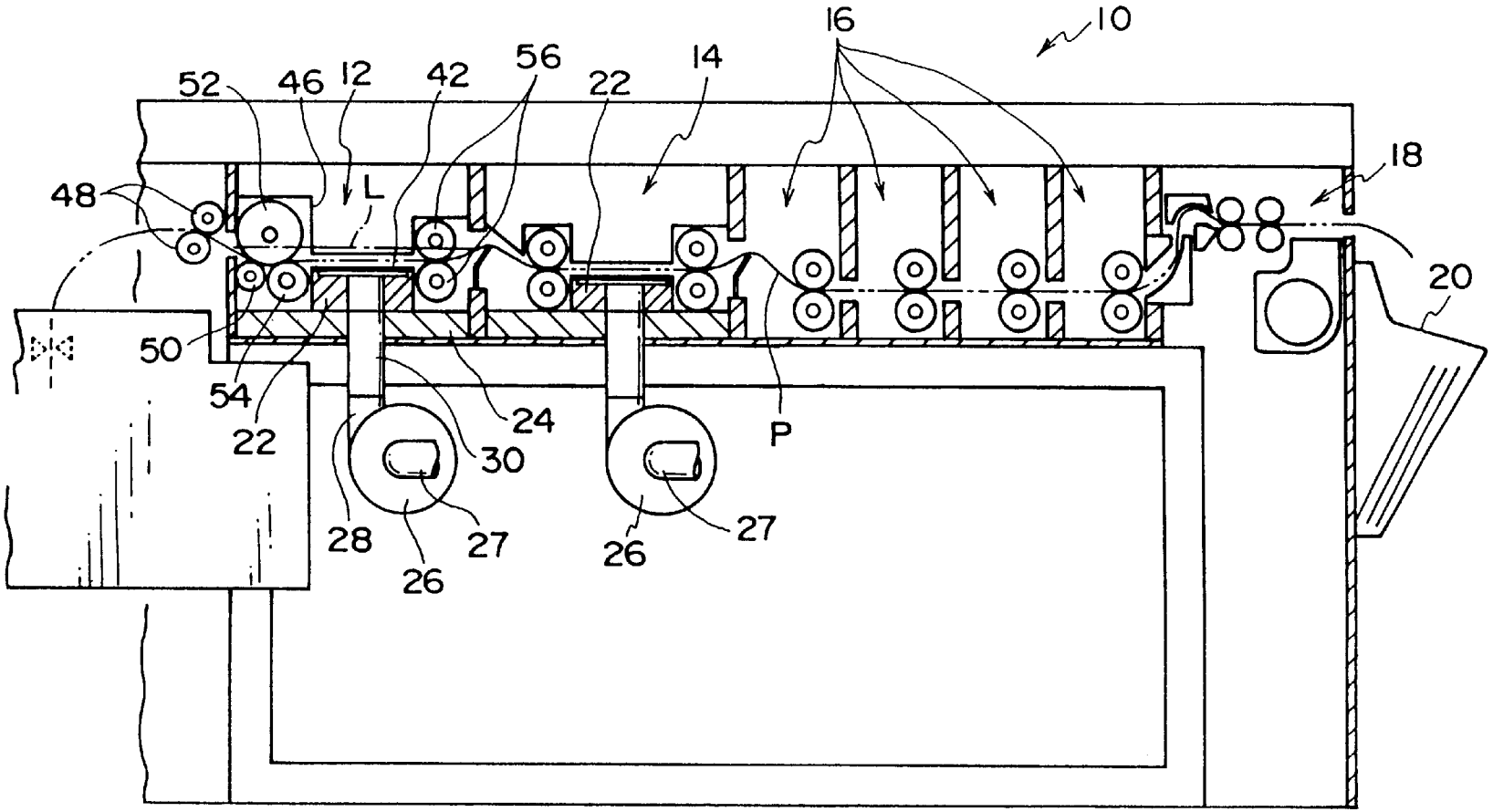
FIG. 2 is a cross-sectional side view of the developing processing apparatus according to the embodiment of the present invention.

FIGS. 1 and 2 each show a developing processing apparatus 10 according to an embodiment of the present invention.

The developing processing apparatus 10 is a system in which a photosensitive material is subjected to developing processing while being conveyed horizontally (in the present invention, the photosensitive material means a silver salt photographic light-sensitive material). A paper P serving as the photosensitive material is processed in a developing tank 12, a bleach-fixing tank 14, a plurality of washing tanks 16, and a drying section 18 in that order while being horizontally conveyed, and is then discharged into a tray 20.

Here, a blowoff chamber 22 which is a characterizing portion of the present invention is provided both in the developing tank 12 and in the bleach-fixing tank 14. The blowoff chambers 22 provided in the two tanks have the same basic structures, and therefore, a description will be given, as an example, of the blowoff chamber disposed in the developing tank 12. In the present invention, the blowoff chamber may be provided in one or both of the developing tank and the bleach-fixing tank.

A liquid-distributing block 24 is provided on a bottom surface of the developing tank 12. A developing solution is sent to the liquid-distributing block 24 from a circulating pump 26 via a liquid-distributing pipe 28. The liquid-distributing pipe 28 branches out into three connecting pipes 30 and the liquid-distributing block 24 is provided with discharging pipes 32 communicating with the connecting pipes 30 respectively.

On the other hand, recovery holes 34 are formed in a side wall of the developing tank 12 and used to regulate a liquid level of the developing solution. The developing solution is recovered into an auxiliary tank 36 via the recovery holes 34. The developing solution recovered into the auxiliary tank 36 is, if necessary, replenished with a replenishing agent and water, then delivered from a return pipe 27 via the circulating pump 26 , and thereafter, blown off again from the discharging pipes 32 of the liquid-distributing block 24. A developing solution overflowing from the recovery holes 34 is discharged from an overflow pipe 35.

The blowoff chamber 22 is set on the top surface of the liquid-distributing block 24. Three water absorption openings 38 are formed in the bottom surface of the blowoff chamber 22 at the same intervals as those of the discharging pipes 32 and are provided to communicate with the discharging pipes 32. The three water absorption openings 38 are linked via a rectangular storage portion 40 disposed at an upper side of the water absorption openings 38. The developing solution discharged from the discharging pipes 32 reaches the storage portion 40 at a predetermined hydraulic pressure.

An open side of the storage portion 40 is closed by a jetting panel 42 in which a plurality of jetting holes 44 are formed so as to pass therethrough and the developing solution jetted from the jetting holes 44 is jetted upon an emulsion surface of the paper P.

On the other hand, a processing rack 46 is set on the top side of the developing tank 12. The processing rack 46 is equipped with: an insertion roller pair 48 which guides an exposed paper P from an upper side to a lower side; a set of three conveying rollers 50, 52, and 54, which are located at the downstream side of the blowoff chamber 22 in a direction in which the paper P is conveyed and conveys the paper P to above the jetting holes 44 while correcting the position of the paper P conveyed obliquely by the insertion roller pair 48 into a horizontal position; and a set of conveying rollers 56 for conveying, to the bleach-fixing tank 14, the paper P conveyed above the jetting holes 44 and subjected to developing processing.

Further, the position where the paper P is nipped by the conveying rollers 52 and 54 and the position where the paper P is nipped by the conveying roller pair 56 are located below a liquid level L of the developing solution. When the paper P is nipped by these rollers, the distance between the jetting holes 44 and the paper P is set to be 2.0 mm to 20.0 mm, and in the present embodiment, it is set to be 5.0 mm.

Figures 3A, 3B:
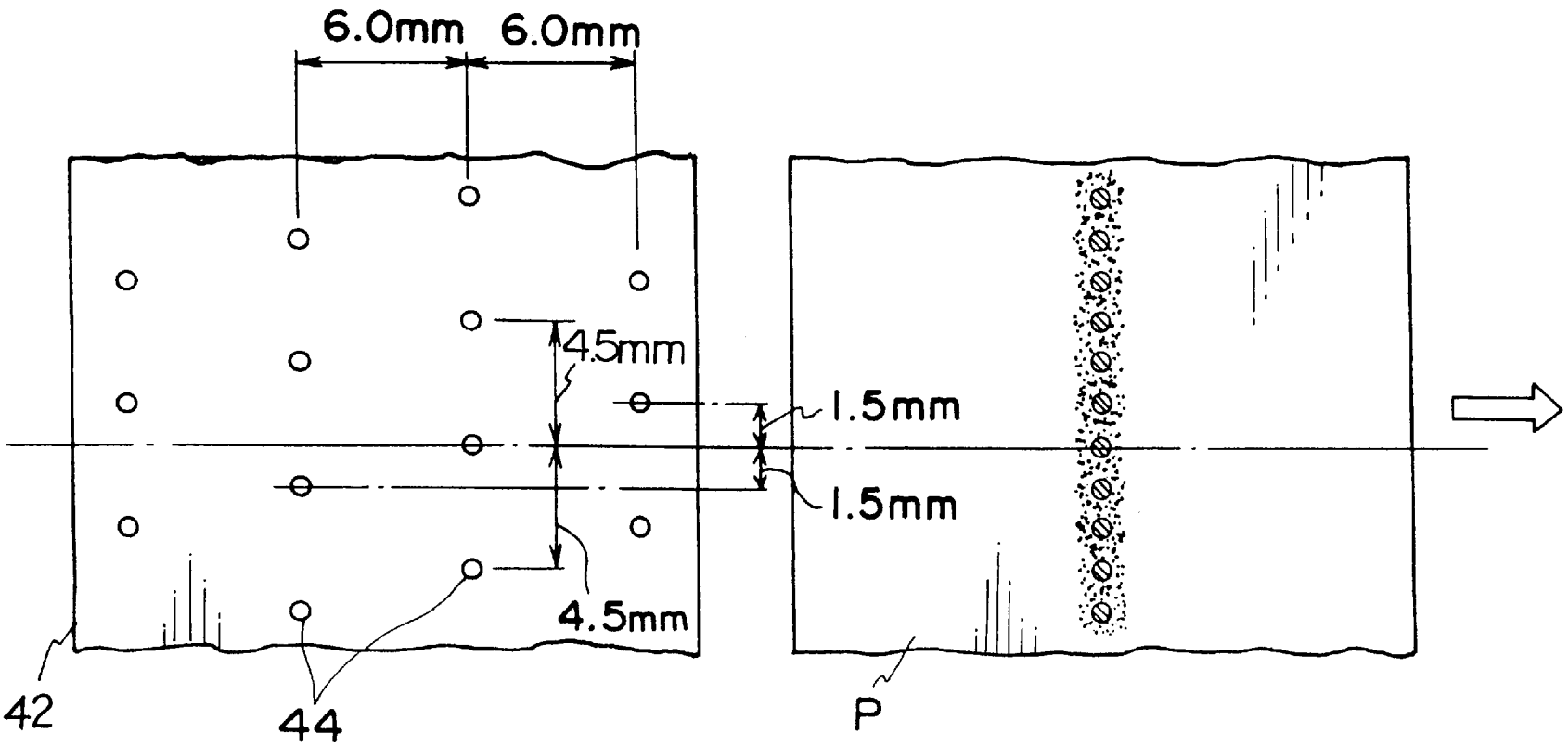
FIGS. 3A and 3B are enlarged plan views which each show arrangement of jetting holes in the developing processing apparatus according to the embodiment of the present invention.

By setting the distance between the jetting holes 44 and the paper P as described above, non-uniform processing of the paper P is prevented in a region of the paper P facing the jetting holes 44 and its peripheries, to thereby improve photographic properties as can be seen by eye from the schematic diagram shown in FIG. 3B.

The positions where the paper P is nipped by the three conveying rollers 50, 52, and 54 are located below the liquid level L of the developing solution. The paper P is nipped by these rollers after having been immersed in the developing solution, and therefore, non-uniform processing is prevented.

Next, the jetting holes 44 of the jetting panel 42 will be described in detail.

As shown in FIG. 3A, the hole diameter of each jetting hole 44 is preferably 0.5 mm to 0.9 mm, and in the present embodiment, it is set to be 0.7 mm. In this case, clogging does not easily occur and a processing solution can be jetted from the jetting holes stably for a long period of time.

Further, the jetting holes 44 are arranged at intervals of 3.0 mm to 4.5 mm in a longitudinal direction of the jetting panel 42 (that is, in a transverse direction of the photosensitive material). The jetting holes 44 are disposed in plural rows in such a manner that the rows of the jetting holes 44 form a staggered arrangement. In the present embodiment, these holes are arranged at intervals of 4.5 mm (from the centers of the holes) in the longitudinal direction of the jetting panel 42. Adjacent three rows of the jetting holes 44 are located at different position from each other to form the staggered arrangement, and the three rows are formed repeatedly on the jetting panel 42. As a result, when seen from the direction in which the paper P is conveyed, the interval of the jetting holes 44 is substantially set to be 4.5 mm/3=1.5 mm.

When the intervals of the jetting holes 44 in the transverse direction of the paper P are substantially made narrower as described above, non-uniform processing does not occur and desired photographic properties can be obtained.

Further, the jetting holes 44 are arranged at intervals of 6.0 mm in the direction in which the paper P is conveyed and the total number of the jetting holes is 720, that is, 12 rows of jetting holes are provided in the direction in which the paper P is conveyed and 60 jetting holes are arranged per row in the transverse direction of the paper P. Here, a pump that pumps 20 liters per minute is used as the circulating pump 26. A jet flow amount of the pump for each of the jetting holes 44 is 14.2 liters per minute and this value becomes 854.6 mm/s by calculation in terms of flow velocity.

Figure 4A:
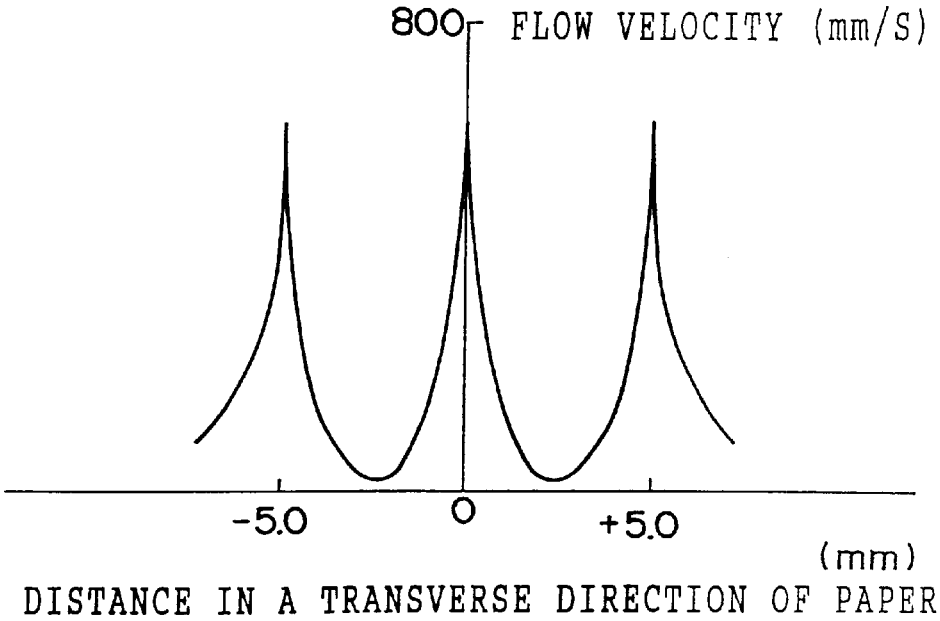
FIGS. 4A and 4B are graphs which each show a distance between a jetting hole and a paper, and flow velocity.
Figure 4B:
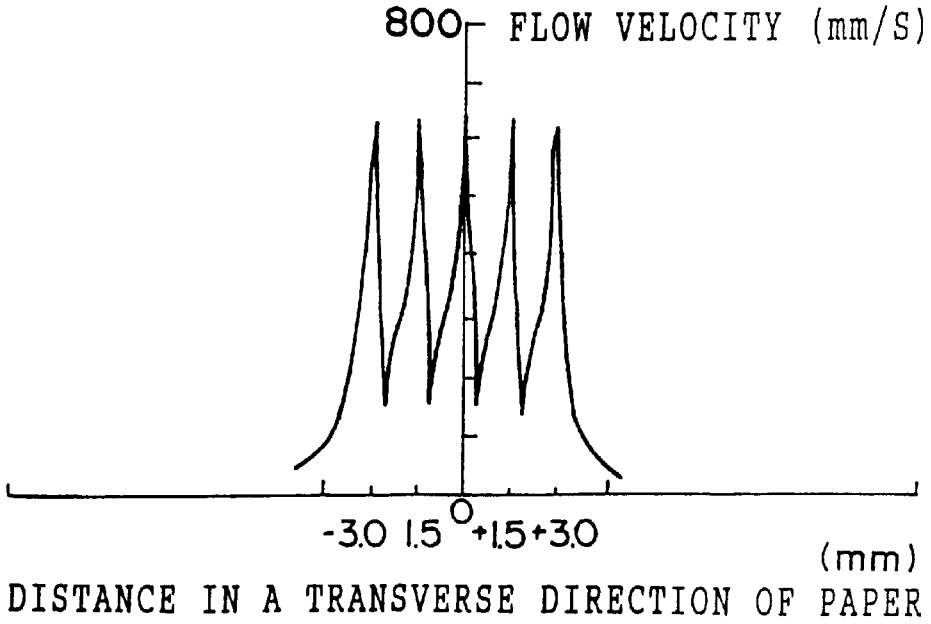

FIGS. 4A and 4B show simulation results obtained by calculation of the distribution of jet flow velocity in the transverse direction of the paper P at a position which is 0.1 mm away from the emulsion surface. FIG. 4A shows an example in which the jetting holes 44 are arranged to form a repetition of a two-row zigzag pattern with adjacent jetting holes 44 being disposed at an interval of 10 mm, and FIG. 4B shows an example in which the jetting holes 44 are arranged to form a repetition of a three-row zigzag pattern with adjacent jetting holes 44 being disposed at an interval of 4.5 mm. In the present invention, the three-row zigzag pattern is more preferable than the two-row zigzag pattern. It can be seen from FIGS. 4A and 4B that, in the three-row zigzag pattern, non-uniform processing does not occur and desired photographic properties are obtained.

As described above, even when a conventional circulating pump 26 is used, the jet flow velocity can be increased depending on a setting pattern of the jetting holes 44, and an ability to agitate the developing solution can be maintained.

[Composition of light-sensitive material]

A composition of a silver halide color photographic light-sensitive material which is preferably combined with the developing processing apparatus of the present invention will be described hereinafter in detail.

In the present invention, a silver halide emulsion layer containing a yellow coupler is preferably provided at a position further away from a substrate than at least one of a silver halide emulsion layer containing a magenta coupler and a silver halide emulsion layer containing a cyan coupler. Further, the silver halide emulsion layer containing a yellow coupler is more preferably provided at a position further away from the substrate than both of the other silver halide emulsion layers from the standpoint of color development, rapidity of desilvering, reduction of residual color caused by sensitizing dyes, and the like. In the present invention, it is preferable to use a silver halide color photographic light-sensitive material in which the silver halide emulsion layer containing a cyan coupler is coated on a substrate, the silver halide emulsion layer containing a magenta coupler is coated on the cyan coupler-containing layer, and the silver halide emulsion layer containing a yellow coupler is finally coated on the magenta coupler-containing layer.

A coating thickness of a photographic composition layer in the present invention is preferably in the range from 1.0 $\mu$m to 9.0 $\mu$m, more preferably in the range from 2.0 $\mu$m to 8.0 $\mu$m, and most preferably in the range from 3.5 $\mu$m to 7.0 $\mu$m. The coating thickness of a photographic composition layer in the silver halide color photographic light-sensitive material used in the present invention indicates a thickness of an unprocessed photographic composition layer located above the substrate. Concretely, the coating thickness of a photographic composition layer can be obtained by any one of the following methods: a method in which the coating thickness is obtained by cutting the silver halide color photographic light-sensitive material perpendicular to the substrate a and observing a cut surface by an electron microscope; and a method in which the coating thickness is calculated from an amount of coating (g/m$^2$) of each of components in the photographic composition layer and a specific gravity thereof. The specific gravity of typical gelatin used for photographic processing is 1.34 g/ml and the specific gravity of silver chloride grains is 5.59 g/ml. The specific gravity of other oleophilic additives can also be measured.

The form of the silver halide grains contained in a photographic emulsion of a light-sensitive material preferably used in the developing processing apparatus of the present invention can be a form of a normal crystal such as cube, octahedron or tetradecahedron, or a form of irregular crystal habit such as spheroid or tablet, or a form of composite type.

A pair of parallel surfaces of a tabular grain, which are placed perpendicular to a direction along the thickness of the tabular particle, is called a principal plane. In the developing processing apparatus of the present invention, it is preferable to process a light-sensitive material including a photographic emulsion which contains a tabular grain having (111) plane as the principal plane or a tabular grain having (100) plane as the principal plane. Further, in the present invention, a light-sensitive material in which a photographic emulsion contains silver halide tabular grains having (100) plane is more preferably used.

Silver halide tabular grains having (111) plane and (100) plane, which are used for the light-sensitive material of the present invention, will be described in detail.

There have been disclosed processes in which various crystal habit controlling agents are used for the preparation of tabular grains. Among these crystal habit controlling agents, compounds described in Japanese Patent Application Laid-Open (JP-A) No. 2-32 (examples of compounds 1 to 42) are preferably used, and crystal habit controlling agents 1 to 29 described in JP-A No. 6-333780 are particularly preferable. However, the present invention is not limited to the same.

The tabular grains having (111) planes are obtained by forming two sets of parallel twinned crystal planes. The formation of the twinned crystal planes depends on a temperature, a dispersion medium (gelatin), halogen concentration, and the like. Therefore, it is necessary to set a proper value for each of these conditions. When the crystal habit controlling agent is allowed to be present at the time of nucleus formation, the concentration of gelatin is preferably in the range from 0.1 to 10 %. The concentration of chloride is set to be 0.01 mol/L or more, preferably 0.03 mol/L or more.

It is preferably that no crystal habit controlling agent be used during nucleus formation in order that the grains be made monodisperse, which is disclosed in JP-A No. 8-184931. When no crystal habit controlling agent is used during nucleus formation, the concentration of gelatin is set in the range from 0.03 to 10%, preferably in the range from 0.05 to 1.0%. The concentration of chloride is set in the range from 0.001 to 1 mol/L, preferably in the range from 0.003 to 0.1 mol/L. The temperature of nucleus formation can be set arbitrarily in the range from 2 to 90° C., preferably in the range from 5 to 80° C., and most preferably in the range from 5 to 40° C.

At the initial stage of nucleus formation, nuclei of tabular grains are formed, and immediately after the formation of nuclei, a large number of nuclei other than those of tabular grains are placed in a reaction vessel. Accordingly, it becomes necessary to use a technique in which ripening is conducted after the nucleus formation, and only nuclei of the tabular grains are allowed to remain and the others are removed. When ordinary Ostwald ripening is carried out, the nuclei of tabular grains are also molten and disappear. Therefore, the nuclei of tabular grains decreases, and the size of the resulting tabular grains thereby increases. In order to solve this problem, a crystal habit controlling agent is added. Particularly with gelatin phthalate being used together, the effect of the crystal habit controlling agent is enhanced to prevent melting of the tabular grains. During the ripening, pAg is particularly important and is preferably in the range from 60 to 130 mV for a silver-silver chloride electrode.

The formed nuclei are allowed to grow in the presence of the crystal habit controlling agent by physical ripening and through the addition of a silver salt and a halide. In this case, the chloride concentration is 5 mol/L or less, and preferably 0.05 to 1 mol/L. The temperature at the time of growth of the nuclei may be selected in the range from 10 and 90° C., but the temperature is preferably in the range from 30 to 80° C.

The total amount of the crystal habit controlling agents used is preferably $6\times10^{-5}$ mol or more, and most preferably in the range from $3\times10^{-4}$ to $6\times10^{-2}$ mol per mol of silver halide in a completed emulsion. The timing of addition of the crystal habit controlling agent may be at any stage between the stage of nucleus formation and the stage of the physical ripening of the silver halide grains. After the addition of the crystal habit controlling agent, growth of (111) plane begins. The crystal habit controlling agent may be placed in a reaction vessel in advance. When small-size tabular grains are formed, the crystal habit controlling agent may be added to the reaction vessel such that its concentration will increase as the grains grow.

When the amount of a dispersion medium used at the time of nucleus formation is not sufficient for the growth of the grains, it is necessary to add the dispersion medium. It is preferable that gelatin be present in the range from 10 g/L to 100 g/L in the growth thereof. An example of gelatin to be added is preferably gelatin phthalate or trimellitic acid-added gelatin.

The value of pH at the time of nucleus formation may be arbitrarily set, and preferably set in the range from a neutral region to an acid region.

Next, a description will be given of tabular grains having (100) planes. The tabular grains having (100) planes are those having (100) plane as a principal plane. The form of the principal plane is a form of a rectangle, a form of a triangle, tetragon, or pentagon with any one angle of the rectangle being omitted (that is, a right-angled triangle having the omitted angle as an apex and formed by two sides which form the angle), or a form of a tetragon, pentagon, hexagon, heptagon, or octagon with two to four angles being omitted. Assuming that the form of a rectangle with the omitted portion being complemented is a complementary tetragon, the ratio of adjacent sides of the rectangle and the complementary tetragon (the ratio between the length of a longer side and that of a shorter side) is in the range from 1 to 6, preferably in the range from 1 to 4, and more preferably in the range from 1 to 2.

The tabular grains of a silver halide emulsion, having (100) principal planes are prepared in such a manner that a silver-salt aqueous solution and a halide-salt aqueous solution are added to and mixed with a dispersion medium such as a gelatin aqueous solution while being stirred. In this case, for example, in JP-A Nos. 6-301129, 6-347929, 9-34045, and 9-96881, there has been disclosed a method in which silver iodide or iodide ion, or silver bromide or bromide ion is allowed to be present to thereby cause distortion in nuclei from difference in crystal lattice size between silver chloride and, for example, silver bromide, and crystal deficiency which imparts anisotropic growth such as screw dislocation is introduced. When the screw dislocation is introduced, two-dimensional nucleus formation on the plane is not any longer rate-controlled under a low supersaturation condition. Therefore, crystallization on the plane advances, and by introducing the screw dislocation, the tabular grains are formed. The low supersaturation condition mentioned herein shows, preferably 35% or less of an amount at the time of critical addition, more preferably 2 to 20%. It is not necessarily determined that the crystal deficiency cause screw dislocation, but it is considered that the screw dislocation be introduced at a high possibility due to a direction in which the dislocation is introduced, or imparting of anisotropic growth to the grains. It is preferable that the introduced dislocation be held so that the tabular grains be made thinner, which is disclosed in JP-A Nos. 8-122954 and 9-189977.

Further, a method for preparing (100) tabular grains with a (100) plane-forming accelerator added thereto is disclosed by using imidazoles, 3,5-diaminotriazoles (in JP-A No. 6-347928) or by using polyvinyl alcohols (in JP-A No. 8-339044). However, the present invention is not limited to the same.

Grains having a high content of silver chloride used in the present invention is grains whose silver chloride content is 80 mole % or more, preferably 95 mole % or more. The grains of the present invention preferably have a so-called core/shell structure comprised of a core section and a shell section surrounding the core section. The core section preferably contains 90 mole % or more of silver chloride. The core section may be comprised of two or more portions having different halogen compositions. The shell section preferably covers 50% or less of the total volume of the grains, most preferably 20% or less. The shell section preferably contains silver iodochloride or silver iodobromochloride. Further, the shell section preferably contains 0.5 to 13 mole % of iodine, most preferably 1 to 13 mole %. A silver iodide content of the total grains is preferably 5 mole % or less, most preferably 1 mole % or less.

The silver bromide content in the shell section is preferably higher than that in the core section. The silver bromide content is preferably 20 mole % or less, most preferably 5 mole % or less.

The silver halide grains used for the light-sensitive material of the present invention are not particularly limited in an average grain size (equivalent-sphere diameter in terms of volume), but the average grain size is preferably in the range from 0.1 to 0.8 $\mu$m, most preferably in the range from 0.1 to 0.6 $\mu$m. The equivalent-circle diameter of the tabular grains is preferably in the range from 0.2 to 1.0 $\mu$m. The equivalent-circle diameter of the silver halide grains mentioned herein is a diameter of a circle whose area is equal to a projected area of the grain in an electron micrograph. Further, the thickness of the grain is 0.2 $\mu$m or less, preferably 0.15 $\mu$m or less, and particularly preferably 0.12 $\mu$m or less. In the present invention, 50% or more of the projected area of all the silver halide grains containing yellow dye-forming couplers has an average aspect ratio (that is, the ratio of the diameter to the thickness of the grains) of 2 or more, preferably 5 to 20.

Generally, the tabular grains are those having two parallel planes. Accordingly, the "thickness" mentioned in the present invention is represented by a distance between the two parallel planes which form the tabular grain.

The grain size distribution of the silver halide grains used in the present invention may be polydisperse or monodisperse, but it is more preferably monodisperse. Particularly, the coefficient of variation in an equivalent-circle diameter of tabular grains which cover 50% or more of the total projected area is preferably 20% or less, and desirably 0%.

EXAMPLES

The present invention will be hereinafter described in accordance with the following examples, but the embodiment of the present invention is not limited to the same.

In the description of examples given below, a blue sensitive emulsion layer, a green sensitive emulsion layer, and a red sensitive emulsion layer are referred to as a yellow-coupler containing layer, a magenta-coupler containing layer, and a cyan-coupler containing layer, respectively, according to circumstances. Further, after developing processing, these emulsion layers are referred to as a yellow coloring layer, a magenta coloring layer, and a cyan coloring layer, respectively. Still further, these emulsion layers may be represented simply as BL, GL, and RL, respectively.

Example 1

(1) Preparation of Samples of Light-sensitive Materials

A sample 111 of example 1 disclosed in JP-A No. 11-24217 was prepared and formed into a roll having a transverse dimension of 254 mm, to thereby prepare a sample 101.

Next, samples 102 and 103 were prepared from the sample 101 by making a change in components of a light-sensitive material shown below.

1. Alteration of Blue Sensitive Silver Halide Emulsion

Sample 102:

A sample 102 of light-sensitive material was prepared by using the same emulsions as those of the sample 101, except that a silver chlorobromide emulsion A which is a yellow-coupler containing layer in the sample 101 was changed to the following emulsion A-II.

Sample 103:

A sample 103 of light-sensitive material was prepared by using the same emulsions as those of the sample 101, except that a silver chlorobromide emulsion A which is a yellow-coupler containing layer in the sample 101 was changed to the following emulsion A-III.

<Preparation of Emulsions>

Preparation of Emulsion A-II [(111) Tabular Grains Having a High Content of Silver Chloride (average grain size: 0.46 $\mu$m)]

2.0 g of sodium chloride and 2.8 g of inert gelatin were added to 1.2 L of water in a vessel and was kept at 33° C. To this solution, 45 cc of a silver nitrate aqueous solution (18 g of silver nitrate) and 45 cc of a sodium chloride aqueous solution (6.4 g of sodium chloride) were added, while being stirred, in double jets for 1 minute. 1 minute after completion of the addition, 0.8 millimole of the following crystal habit controlling agent 1 and 560 g of a gelatin phthalate aqueous solution (10%) were added. Then, 1 minute later, 3.0 g of sodium chloride was added to the mixture. The temperature of a reaction vessel was heated up to 60° C. over 25 minutes, and the mixture was ripened at 60° C. for 16 minutes. Thereafter, 3 g of sodium chloride and $1\times10^{-5}$ mole of sodium thiosulphonate were added to the above mixture. To the mixture, 295 cc of a silver nitrate aqueous solution (18 g of silver nitrate), 295 cc of a sodium chloride aqueous solution (containing 50.3 g of sodium chloride and $2\times10^{-8}$ mole of iridium hexachloride), and 160 cc of an aqueous solution of the crystal habit controlling agent 1 (M/50) were added over 13 minutes at an increased flow rate. 2 minutes later, a silver nitrate aqueous solution (34 g of silver nitrate) and a sodium chloride aqueous solution (containing 11.6 g of sodium chloride and 1.27 mg of yellow prussiate of potash) were further added over 5 minutes. Then, 33.5 cc of a 0.1N thiocyanic acid solution, 0.32 millimole of a sensitizing dye J, 0.48 millimole of a sensitizing dye K, and 0.05 millimole of a sensitizing dye L were added to the mixture.

The mixture was cooled down to 40° C. and demineralized by an ordinary flocculation method. After water washing, 67 g of gelatin, 80 cc of phenol (5%), and 150 cc of distilled water were added, and pH was controlled to 6.2 and pAg was controlled to 7.5 with caustic soda and a silver nitrate solution.

The ratio of tabular grains to total grains was 90% or more of the total projected area of all the obtained grains, and the average equivalent-circle diameter was 0.71 μm, the average thickness was 0.13 μm, and the average equivalent-sphere diameter was 0.46 μm.

Crystal Habit Controlling Agent 1

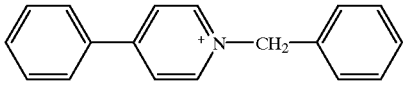

(2) Preparation of Emulsion A-II I [(100) Tabular Grains Having a High Content of Silver Chloride (average grain size: 0.47 μm)]

1.2 L of water, 25 g of gelatin (deionized alkaline-treatment bone gelatin whose methionine content is about 40 μmol/g), 0.4 g of sodium chloride, and 4.5 ml of a solution of nitrate (1N) were placed in a reaction vessel (pH: 4.5) and kept at 40° C. To the mixture, an Ag-1 solution (silver nitrate is contained at the rate of 0.2 g/cc) and an X-1 solution (sodium chloride is contained at the rate of 0.069 g/cc) were added and mixed for 4 minutes at the rate of 48 cc/min. while being strongly stirred. 15 seconds later, 150 ml of a polyvinyl alcohol aqueous solution (containing 6.7 g of polyvinyl alcohol (PVA-1) in which an average degree of polymerization of vinyl acetate is 1700 and an average saponification rate for alcohol is 98% or more, and also containing 1 L of $H_2O$) was further added.

To the obtained mixture, 12.3 ml of a solution of nitrate (1N) was added and pH was controlled to 3.5. The mixture was heated up to 75° C. over 15 minutes, and 23 ml of a solution of sodium hydroxide (1N) was added and pH was controlled to 6.5. To the mixture, 4.0 ml of 1-(5-methylureidophenyl)-5-mercaptotetrazole (0.05%) and 4.0 ml of N,N'-dimethylimidazoligene-2-thion (1% aqueous solution) were added. 4 g of sodium chloride was added and a silver potential (against a room-temperature saturated calomel electrode) was adjusted to 100 mV. Thereafter, an Ag-1 solution and an X-1 solution were added simultaneously for 15 minutes, so as to allow growth of grains, while the flow rate being increased linearly from 40 cc/min. to 42 cc/min. with the silver potential being kept at 100 mV. To the obtained mixture, 12.5 ml of a solution of nitrate (1N) was added and pH was controlled to 4.0.28.8 g of sodium chloride was added and the silver potential was controlled to 60 mV, and thereafter, 0.38 millimole of a sensitizing dye J, 0.56 millimole of sensitizing dye K, and 0.06 millimole of a sensitizing dye L were added and an Ag-2 solution (silver nitrate: 0.1 g/cc) and an X-2 solution (sodium chloride: 0.0345 g/cc) were added for 10 minutes at the low rate of 40 cc/min., and thereafter, the mixture was allowed to stand for 10 minutes at 75° C.

Thereafter, the resulting mixture was washed by precipitation at 40° C., and was thereby demineralized 79 g of gelatin was added to disperse again the emulsion, and pH was controlled to 6.0 and pAg was controlled to 7.3. Then, a portion of the emulsion was sampled and an electron photomicrographic image (TEM image) of a replica of the grains was observed. As a result, the ratio of tabular grains having (100) plane as a principal plane to total grains was 90% of the total projected area of all the AgX grains, and the average equivalent-sphere diameter was 0.47 μm, the average grain thickness was 0.10 μm, and the average aspect ratio was 7.8, and the average adjacent edge ratio was 1.2.

Sensitizing dye J

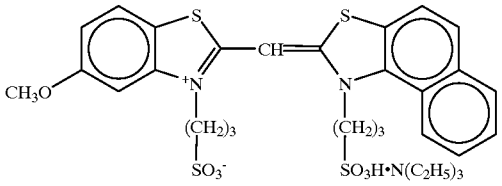

Sensitizing dye K

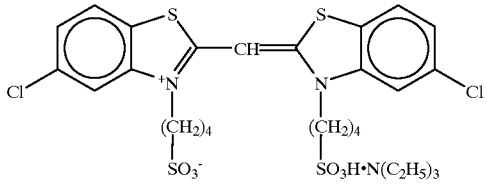

Sensitizing dye L

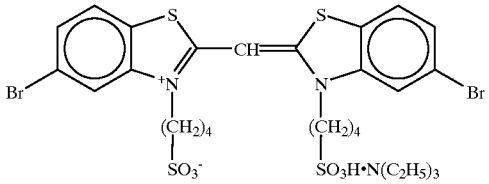

2. Alteration of Coating Sequence of Coloring Layers and Alteration of Amount of Gelatin Sample 102:

In the sample 102, coloring layers were formed in the order of yellow, magenta, and cyan from the side of a substrate by changing the order in which the coloring layers are formed in the sample 101. Further, the sample 102 was prepared in the same way as in the sample 101, except that a total amount of gelatin is changed from 7.12 to 5.69 g/m$^2$ by reducing an amount of a gelatin binder of each of other layers than the yellow-coupler containing layer in the sample 101 by 25%.

Sample 103:

The sample 103 was prepared in the same way as in the sample 101, except that a total amount of gelatin is changed from 7.12 to 5.69 g/m$^2$ by reducing an amount of a gelatin binder of each of other layers than the yellow-coupler containing layer in the sample 101 by 25%.

(2) Developing Processing and Evaluations

1. Exposure and Processing Conditions for Color Paper

A human figure was photographed at the center of a background of outdoors and fine weather on a commercial color negative film (Fuji Color Negative Film Super 400 manufactured by Fuji Photo Film Co., Ltd.), and the color film was subjected to developing processing using an automatic processor FP-363SC manufactured by Fuji Photo Film Co., Ltd., and a color negative film processing formula CN-16S and its processing chemicals (which are both manufactured by Fuji Photo Film Co., Ltd.).

Image information was read from the developed color negative film by an input device/scanner-image processor SP 1500 (manufactured by Fuji Photo Film Co., Ltd.), and the sample 102 was exposed by a laser exposure unit using the processing apparatus of the present embodiment shown in FIG. 2, and running processing was carried out by processes and processing solutions, which will be described later, until an accumulated amount of replenishment of a developing solution becomes three times the capacity of the tank.

A mini-lab printer processor PP728 manufactured by Fuji Photo Film Co., Ltd. was used as a comparative processor in carrying out the running processing. The processor PP728 was modified so that a processing time can be arbitrarily changed. The sample 102 was exposed by a plane exposure unit installed in the processor PP728 using the above-described developed color negative film, and the running processing was carried out in the same processes and processing solutions as those of the present embodiment.

| Process | Temperature | Time | Replenisher* | Tank capacity |
|---|---|---|---|---|
| Color development | 45° C. | 15 seconds | 35 ml | 1.5 L |
| Bleach-fix | 40° C. | 15 seconds | 35 ml | 1.5 L |
| Rinsing 1 | 40° C. | 4 seconds | | 0.5 L |
| Rinsing 2 | 40° C. | 4 seconds | | 0.5 L |
| Rinsing 3 | 40° C. | 4 seconds | | 0.5 L |
| Ringing 4 | 40° C. | 8 seconds | 180 ml | 1.0 L |
| Drying | 85° C. | 10 seconds | | |

*An amount of replenisher is indicated by an amount per square meter of light-sensitive material.

The rinsing process is effected by using four tanks and these tanks are formed as a countercurrent flow system from the fourth to the first one.

The compositions of the processing solutions are described below.

| | (in a tank) | (to be replenished) |
|---|---|---|
| Color developing solution: | | |
| water | 800 ml | 800 ml |
| triisopropanolamine | 0.2 mol | 0.2 mol |
| ethylenediamine tetraacetate | 4.0 g | 4.0 g |
| 4,5-dihydroxybenzene-1,3-disodium disulphonate | 0.5 g | 0.5 g |
| potassium chloride | 15.8 g | — |
| potassium bromide | 0.045 g | — |
| sodium sulfite | 0.1 g | 0.1 g |
| fluorescent whitening agent Hakkoi FWA-SF (manufactured by Showa Chemical Industry Co., Ltd.) | 4.0 g | 8.0 g |
| sodium p-toluenesulfonate | 20.0 g | 20.0 g |
| disodium-N,N-bis(sulfonatoethyl)hydroxylamine | 20.0 g | 20.0 g |
| N-ethyl-N-(β-methanesulfonamidethyl)-3-methyl-4-aminoaniline · 3/2 sulfate monohydrate | 6.0 g | 24.0 g |
| potassium carbonate | 26.3 g | 26.3 g |
| addition of water | 1000 ml | 1000 ml |
| pH (25° C./adjusted by potassium hydroxide) | 10.35 | 12.60 |
| Bleach-fixing solution: | | |
| water | 500 ml | 500 ml |
| ammonium thiosulfate (75%) | 104 ml | 193 ml |
| ethylenediamine tetraacetatic acid | 3.2 g | 5.9 g |
| ethylenediamine tetraacetatic acid, iron (III) ammonium salt dihydrate | 62.0 g | 124.0 g |
| ammonium sulfite monohydrate | 58.0 g | 116.0 g |
| ammonium bromide | 10.0 g | 20.0 g |
| n-butylguanidine half sulfate | 6.6 g | 14.8 g |
| succinic acid (50%) | 24.0 g | 44.0 g |
| addition of water | 1000 ml | 1000 ml |
| pH (25° C.: adjusted by nitric acid) | 5.50 | 4.98 |
| Rinsing solution (a solution contained in the tank and a solution to be replenished have the same compositions) | | |
| chlorinated sodium isocyanurate | 0.2 g | |
| deionized water (conductivity: 5 μs/cm or less) | 1000 ml | |
| pH | 6.5 | |

2. Evaluation of Photographic Properties

After completion of the running processing, developing processing was carried out under experimental conditions shown in Table 1 after a continuous tone wedge exposure was applied to the samples 101 to 103 using a sensitometer (manufactured by Fuji Photo Film Co., Ltd., FW type, color temperature of a light source is 3200K, exposure time is 0.1 second, and an amount of exposure is 250 CMS). The densities of the developed samples were measured and the maximum density portions (Dmax) measured by blue light (filter light corresponding to status A) were read from the characteristic curves.

The evaluation of photographic properties is made by calculating the following expression on the basis of values of the samples by the mini-lab printer processor PP728 manufactured by Fuji Photo Film Co., Ltd.

If the value of ΔDmax(B) is positive, the ability of agitation higher than that of the comparative processor is realized, which is shown as a preferred embodiment.

$$\Delta Dmax(B)=[Dmax(B) \text{ in each experimental condition}]-[Dmax(B) \text{ in PP728}]$$

3. Evaluation of Processing Irregularity

After completion of the running processing, a gray wall was photographed at a standard amount of exposure in the state of being illuminated by a light source of standard C mentioned in ISO5800 (sensitometry of color negative film) on a Fuji Color Negative Film Super 400 (manufactured by Fuji Photo Film Co., LTD.), and the samples 101 to 103 which are each cut in 2L-size (which is 127 mm×178 mm) were exposed in the same manner as in Example 1 (a wall density of a finished color print is adjusted so that each density of the three colors B, G, and R are each in a range from 0.75 to 0.85) and the processing was carried out every 20 sheets under the conditions shown in Table 1. The flow rate of circulation of the pump was adjusted so as to become 10 L/min. under all the conditions.

The processing irregularity was evaluated for the obtained color prints on the basis of the following criteria:

[Streaked marks]

○: no streaked mark occurs;

Δ: streaked marks were found at 1 to 5 portions among 20 sheets of prints;

X: streaked marks were found at 6 to 10 portions among 20 sheets of prints; and

XX: streaked marks were found at 11 or more portions among 20 sheets of prints.

The results are shown in FIG. 3. It can be seen from Table 1 that a desired photographic property can be obtained by the present embodiment without causing processing irregularity. The desired photographic property mentioned herein indicates an effect of agitation in a processor. Accordingly, Table 1 shows that the ability of agitation of the present embodiment is higher than that of a comparative processor, and it can be seen that the present invention is excellent in rapidity of processing. Further, it can also be understood that combination of the processing apparatus according to the present invention and the sample 102 allows compatibility between the photographic property and the conveying property in a more stabilized region.

TABLE 1

| Experimental condition | Sample | Jetting hole diameter | Number of holes | Interval of jetting holes in a transverse direction of photosensitive material |
|---|---|---|---|---|
| 1 | 101 | 0.7 mm | 402 | 4.5 mm (three-row zigzag pattern) |
| 2 | 101 | 0.5 mm | 932 | 3.0 mm (two-row zigzag pattern) |
| 3 | 101 | 0.5 mm | 1090 | 5.0 mm (two-row zigzag pattern) |
| 4 | 102 | 1.0 mm | 330 | 10 mm (two-row zigzag pattern) |
| 1 | 102 | 0.7 mm | 402 | 4.5 mm (three-row zigzag pattern) |
| 2 | 102 | 0.5 mm | 932 | 3.0 mm (two-row zigzag pattern) |
| 3 | 102 | 0.5 mm | 1090 | 5.0 mm (two-row zigzag pattern) |
| 4 | 102 | 1.0 mm | 330 | 10 mm (two-row zigzag pattern) |
| 1 | 103 | 0.7 mm | 402 | 4.5 mm (three-row zigzag pattern) |
| 2 | 103 | 0.5 mm | 932 | 3.0 mm (two-row zigzag pattern) |
| 3 | 103 | 0.5 mm | 1090 | 5.0 mm (two-row zigzag pattern) |
| 4 | 103 | 1.0 mm | 330 | 10 mm (two-row zigzag pattern |

| Experimental condition | Flow rate of jetting holes | ΔDmax (B) | Streaked marks | Note |
|---|---|---|---|---|
| 1 | 1078 mm/s | +0.004 | ○ | Present invention |
| 2 | 911 mm/s | +0.002 | ○ | Present invention |
| 3 | 779 mm/s | +0.005 | Δ | Present invention |
| 4 | 643 mm/s | −0.010 | × × | Comparative example |
| 1 | 1078 mm/s | +0.007 | ○ | Present invention |
| 2 | 911 mm/s | +0.006 | ○ | Present invention |
| 3 | 779 mm/s | +0.007 | ○ | Present invention |
| 4 | 643 mm/s | −0.009 | × × | Comparative example |
| 1 | 1078 mm/s | +0.005 | ○ | Present invention |
| 2 | 911 mm/s | +0.004 | ○ | Present invention |
| 3 | 779 mm/s | +0.005 | Δ | Present invention |
| 4 | 643 mm/s | −0.010 | × × | Comparative example |

The present invention thus provides the above-described structure, and therefore, necessary jet flow can be realized even in conventional pumps, and non-uniform processing caused by clogging does not occur, and further, desired photographic properties can be obtained.

What is claimed is:

1. A developing processing apparatus equipped with a blowoff chamber having jetting holes from which a processing solution is jetted toward an emulsion surface of a photosensitive material, wherein the jetting; holes are formed in such a manner that a hole diameter thereof is in a range of 0.5 mm to 0.9 mm and intervals thereof in a transverse direction of the photosensitive material are each in a range of 3.0 mm to 4.5 mm, and the jetting holes are arranged in a staggered manner in a direction in which the photosensitive material is conveyed; and a number of the jetting holes is set in accordance with capacity of a pump for sending the processing solution to the blowoff chamber so that flow velocity of the processing solution jetted from the jetting holes becomes a value in a ran e of 680 to 1,200 mm/sec.

2. A developing processing apparatus according to claim 1, wherein the photosensitive material is nipped and conveyed by rollers disposed at upstream and downstream sides of the blowoff chamber in a direction in which the photosensitive material is conveyed such that an interval between the jetting holes and the emulsion surface of the photosensitive material is in a range of 2.0 mm to 20.0 mm.

3. A developing processing apparatus according to claim 1, wherein the number of the jetting holes is set in accordance with the capacity of the pump for sending the processing solution to the blowoff chamber such that the flow velocity of the processing solution jetted from the jetting holes is in a range of 700 to 1,100 mm/second and the hole diameter of the jetting holes is in a range of 0.5 mm to 0.8 mm.

4. A developing processing apparatus according to claim 1, wherein the photosensitive material is nipped and conveyed by rollers disposed at upstream and downstream sides of the blowoff chamber in the direction in which the photosensitive material is conveyed such that the interval between the jetting holes and the emulsion surface of the photosensitive material is in the range of 5.0 mm to 10.0 mm.

5. A developing processing apparatus according to claim 1, wherein the jetting holes are disposed in plural rows, and adjacent three rows of the jetting holes are located at different positions from each other to form the staggered arrangement, and the three rows of holes are formed repeatedly on a jetting panel.

6. A developing processing apparatus according to claim 5, wherein intervals of the jetting holes are each in a range of about 1.0 mm to 1.5 mm when seen from the direction in which the photosensitive material is conveyed.

7. A developing processing apparatus according to claim 1, wherein the jetting holes are disposed in two rows, and adjacent two rows of the jetting holes are located at different positions from each other to form the staggered arrangement, and the two rows of holes are formed repeatedly on a jetting panel.

8. A developing processing apparatus according to claim 7, wherein intervals of the jetting holes are each in a range of about 1.5 mm to 2.25 mm when seen from the direction in which the photosensitive material is conveyed.

9. A developing processing apparatus according to claim 1, wherein a blowoff chamber is disposed in each of a developing tank and a bleach-fixing tank.

10. A developing processing method in which a processing solution is jetted toward an emulsion surface of a photosensitive material by a blowoff chamber having jetting holes formed therein, wherein the jetting holes are formed in such a manner that a hole diameter thereof is in a range of 0.5 mm to 0.9 mm and intervals thereof in a transverse direction of the photosensitive material are each in a range of 3.0 mm to 4.5 mm, and the jetting holes are arranged in a staggered manner in a direction in which the photosensitive material is conveyed; and flow velocity of the processing solution jetted from the jetting holes becomes a value in a range of 680 to 1,200 mm/sec by setting a number of the jetting holes in accordance with capacity of a pump for sending the processing solution to the blowoff chamber.

11. A developing processing method according to claim 10, wherein the photosensitive material is nipped and conveyed by rollers disposed at upstream and downstream sides of the blowoff chamber in a direction in which the photosensitive material is conveyed such that an interval between the jetting holes and the emulsion surface of the photosensitive material is in a range of 2.0 mm to 20.0 mm.

12. A developing processing method according to claim 10, wherein the number of the jetting holes is set in accordance with the capacity of a pump for sending the processing solution to the blowoff chamber such that the flow velocity of the processing solution jetted from the jetting holes is in a range of 700 to 1,100 mm/second and the hole diameter of the jetting holes is in a range of 0.5 mm to 0.8 mm.

13. A developing processing method according to claim 11, wherein the photosensitive material is nipped and conveyed by rollers disposed at upstream and downstream sides of the blowoff chamber in the direction in which the photosensitive material is conveyed such that the interval between the jetting holes and the emulsion surface of the photosensitive material is in a range of 5.0 mm to 10.0 mm.

14. A developing processing method according to claim 10, wherein the jetting holes are disposed in plural rows, and adjacent three rows of the jetting holes are located at different positions from each other to form the staggered arrangement, and the three rows of holes are formed repeatedly on a jetting panel.

15. A developing processing method according to claim 14, wherein intervals of the jetting holes are each in a range of 1.0 mm to 1.5 mm when seen from the direction in which the photosensitive material is conveyed.

16. A developing processing method according to claim 10, wherein the jetting holes are disposed in two rows, and adjacent two rows of the jetting holes are located at different positions from each other to form the staggered arrangement, and the two rows of holes are formed repeatedly on a jetting panel.

17. A developing processing method according to claim 16, wherein intervals of the jetting holes are each in a range of 1.5 mm to 2.25 mm when seen from the direction in which the photosensitive material is conveyed.

18. A developing processing method according to claim 10, wherein a blowoff chamber is disposed in each of a developing tank and a bleach-fixing tank.

* * * * *